US012543816B2

(12) United States Patent
Aoki et al.

(10) Patent No.: US 12,543,816 B2
(45) Date of Patent: Feb. 10, 2026

(54) CYCLING SHOE SYSTEM

(71) Applicant: Shimano Inc., Osaka (JP)

(72) Inventors: Toshiaki Aoki, Osaka (JP); Kaoru Ouchi, Osaka (JP); Kadunori Iuchi, Osaka (JP); Shota Nishijima, Osaka (JP)

(73) Assignee: Shimano Inc., Osaka (JP)

( * ) Notice: Subject to any disclaimer, the term of this patent is extended or adjusted under 35 U.S.C. 154(b) by 75 days.

(21) Appl. No.: 17/502,743

(22) Filed: Oct. 15, 2021

(65) Prior Publication Data

US 2023/0122485 A1 Apr. 20, 2023

(51) Int. Cl.

| | |
|---|---|
| ***A43B 5/14*** | (2006.01) |
| ***A43B 3/35*** | (2022.01) |
| ***A43B 11/00*** | (2006.01) |
| ***A43C 11/16*** | (2006.01) |

(52) U.S. Cl.

CPC ..... *A43B 5/14* (2013.01); *A43B 3/35* (2022.01); *A43B 11/00* (2013.01); *A43C 11/165* (2013.01)

(58) Field of Classification Search

CPC .. A43B 5/14; A43B 3/35; A43B 11/00; A43C 11/165

See application file for complete search history.

(56) References Cited

U.S. PATENT DOCUMENTS

| | | | | |
|---|---|---|---|---|
| 8,091,182 | B2 | 1/2012 | Hammerslag et al. | |
| 8,468,657 | B2 | 6/2013 | Soderberg et al. | |
| 9,055,779 | B2 | 6/2015 | Ouchi | |
| 9,101,181 | B2 | 8/2015 | Soderberg et al. | |
| 9,375,053 | B2 | 6/2016 | Burns et al. | |
| 9,380,834 | B2 * | 7/2016 | Rushbrook | A41B 1/08 |
| 9,629,418 | B2 * | 4/2017 | Rushbrook | A43B 23/047 |
| 9,730,482 | B2 * | 8/2017 | Allen | A42B 3/046 |
| 10,034,512 | B2 * | 7/2018 | Rushbrook | A43B 23/0295 |
| 10,070,683 | B2 * | 9/2018 | Rushbrook | A43B 5/025 |
| 10,123,589 | B2 | 11/2018 | Soderberg et al. | |
| 10,376,018 | B2 * | 8/2019 | Rushbrook | A43C 11/22 |
| 10,575,591 | B2 | 3/2020 | Schum et al. | |
| 10,986,888 | B2 * | 4/2021 | Rushbrook | A41D 1/06 |
| 11,206,892 | B2 * | 12/2021 | Rushbrook | A43B 23/0235 |
| 2005/0022427 | A1 | 2/2005 | Kerns et al. | |
| 2007/0245835 | A1 * | 10/2007 | Hauschildt | A43B 3/44 73/862.391 |
| 2013/0104429 | A1 * | 5/2013 | Torres | A43C 1/003 36/136 |
| 2014/0070042 | A1 | 3/2014 | Beers et al. | |

(Continued)

*Primary Examiner* — Bao-Thieu L Nguyen

(74) *Attorney, Agent, or Firm* — Spencer Fane, LLP

(57) ABSTRACT

A cycling shoe system is basically includes an upper, a sole, a closure, an actuator, a communicator and a controller. The upper has a first portion, a second portion, and an opening between the first portion and the second portion. The sole is attached to the upper. The closure is coupled between the first portion and the second portion. The actuator is operatively coupled to the closure to adjust a relative position of the first portion and the second portion. The communicator is configured to receive at least one of bicycle information and user information. The controller is configured to control the actuator to adjust a tightening force applied by the closure to a target tightening force based on at least one of the bicycle information and the user information.

15 Claims, 7 Drawing Sheets

(56) References Cited

U.S. PATENT DOCUMENTS

2014/0257156 A1* 9/2014 Capra ..... A43C 11/165 602/5
2015/0025816 A1* 1/2015 Ross ..... A61B 5/11 702/44
2015/0040429 A1* 2/2015 Beers ..... A43B 3/34 36/83
2015/0047230 A1* 2/2015 Beers ..... A43B 23/047 36/102
2015/0253210 A1* 9/2015 Ashby ..... A43B 5/14 702/41
2015/0257679 A1* 9/2015 Ross ..... G01L 5/0052 702/44
2015/0289594 A1* 10/2015 Rushbrook ..... A43B 17/00 12/142 T
2015/0289595 A1* 10/2015 Rushbrook ..... A43C 11/008 36/50.1
2015/0289596 A1* 10/2015 Beers ..... A43C 11/00 36/50.1
2015/0296922 A1* 10/2015 Rushbrook ..... G05B 19/401 36/68
2016/0157561 A1* 6/2016 Schum ..... A43C 11/165 242/390
2016/0198803 A1 7/2016 Soderberg et al.
2016/0262924 A1* 9/2016 Abreu ..... A43B 7/005
2017/0055626 A1* 3/2017 Rushbrook ..... A43B 13/141
2017/0106940 A1* 4/2017 Paick ..... B62M 6/50
2017/0178471 A1* 6/2017 Levesque ..... A41D 1/002
2017/0241797 A1* 8/2017 Kong ..... A61B 5/1123
2017/0265575 A1* 9/2017 Beers ..... A43C 3/00
2017/0265576 A1* 9/2017 Beers ..... A43B 11/00
2017/0265577 A1* 9/2017 Schneider ..... A43B 3/34
2017/0265586 A1* 9/2017 Schneider ..... A43C 1/00
2017/0265591 A1* 9/2017 Schneider ..... B65H 59/00
2017/0265594 A1* 9/2017 Walker ..... G01L 1/14
2018/0199671 A1* 7/2018 Schneider ..... A43C 7/06
2018/0199673 A1* 7/2018 Schneider ..... A43C 7/06
2018/0199674 A1* 7/2018 Walker ..... A43B 3/36
2018/0219403 A1* 8/2018 Schneider ..... H02J 50/10
2018/0343978 A1* 12/2018 Stillman ..... B65H 59/00
2019/0098963 A1* 4/2019 Beers ..... A43C 11/008
2019/0116915 A1* 4/2019 Andon ..... A43C 11/008
2019/0116937 A1* 4/2019 Avar ..... A43C 11/165
2019/0246745 A1* 8/2019 Bock ..... A43C 11/20
2019/0246746 A1* 8/2019 Bock ..... A43B 3/34
2019/0246747 A1* 8/2019 Bock ..... A43C 11/165
2019/0254380 A1* 8/2019 Vamvas ..... A43B 3/38
2019/0328079 A1* 10/2019 Ashby ..... A61B 5/6807
2019/0328085 A1* 10/2019 Bock ..... A43B 3/34
2019/0380426 A1* 12/2019 Sun ..... A43B 5/04
2019/0387840 A1* 12/2019 Walker ..... A43C 1/00
2020/0054096 A1* 2/2020 Beers ..... F16D 11/10
2020/0068981 A1* 3/2020 Aznoe ..... A43C 7/08
2020/0068982 A1* 3/2020 Schneider ..... A43C 7/005
2020/0068999 A1* 3/2020 Donohoe ..... A43C 11/008
2020/0163416 A1* 5/2020 Kwon ..... A61B 5/11
2020/0170351 A1* 6/2020 Donohoe ..... H02P 6/16
2020/0170352 A1* 6/2020 Avar ..... A43B 3/40
2020/0375506 A1* 12/2020 Bishop ..... B65H 75/4486
2021/0012902 A1* 1/2021 Chawla ..... G06F 18/24133
2021/0112922 A1* 4/2021 Bock ..... A43C 1/006
2021/0118419 A1* 4/2021 Bock ..... A43C 1/00
2021/0161245 A1* 6/2021 Ashby ..... G01L 1/142
2021/0330036 A1* 10/2021 Labelle ..... A43C 1/06
2022/0015496 A1* 1/2022 Henrichot ..... A43B 7/084
2022/0175090 A1* 6/2022 Sekii ..... A43C 11/165
2022/0193490 A1* 6/2022 Ghiotto ..... A43C 11/165
2022/0338558 A1* 10/2022 Hopkins ..... A41F 15/002
2023/0058535 A1* 2/2023 Pheil ..... G01D 5/264

* cited by examiner

CYCLING SHOE SYSTEM

BACKGROUND

Technical Field

This disclosure generally relates to a cycling shoe system. More specifically, the present disclosure relates to a cycling shoe system having a shoe with a closure that applies a tightening force to an upper of the shoe for tightening the upper to a wear's foot.

Background Information

Generally, a cycling shoe has an upper and a sole. The upper is fixed to the sole, and is configured to receive a wear's foot. Typically, the upper has a first portion, a second portion, and an opening between the first portion and the second portion. In some cycling shoes, a closure is coupled between the first portion and the second portion for applying a tightening force to the upper for tightening the upper to a wear's foot. There are many types of closures that are used for cycling shoes. For example, U.S. Pat. No. 9,055,779 (assigned to Shimano Inc.) discloses a cycling shoe having a fixing strap with a hook and loop fastener attachment for tightening the upper to a wear's foot. Another example, a cycling shoe is disclosed in U.S. Pat. No. 8,468,657 (assigned to Boa Technology, Inc.) in which a lacing cord wound on a reel based closure is used for tightening the upper to a wear's foot.

SUMMARY

Generally, the present disclosure is directed to various features of a cycling shoe system having a shoe with a closure that applies a tightening force to an upper of the shoe for tightening the upper to a wear's foot.

In view of the state of the known technology and in accordance with a first aspect of the present disclosure, a cycling shoe system is provided that basically comprises an upper, a sole, a closure, an actuator, a communicator and a controller. The upper has a first portion, a second portion, and an opening between the first portion and the second portion. The sole is attached to the upper. The closure is coupled between the first portion and the second portion. The actuator is operatively coupled to the closure to adjust a relative position of the first portion and the second portion. The communicator is configured to receive at least one of bicycle information and user information. The controller is configured to control the actuator to adjust a tightening force applied by the closure to a target tightening force based on at least one of the bicycle information and the user information.

With the cycling shoe system according to the first aspect, it is possible to adjust a tightening force to be applied by the closure in accordance with at least one of the bicycle information and the user information.

In accordance with a second aspect of the present disclosure, the cycling shoe system according to the first aspect further comprises a first sensor configured to detect the tightening force applied to the upper between the first portion and the second portion.

With the cycling shoe system according to the second aspect, it is possible to easily determine the tightening force that is applied to the upper between the first portion and the second portion using a sensor.

In accordance with a third aspect of the present disclosure, the cycling shoe system according to the first aspect or the second aspect is configured so that the closure is configured to be manually tightened.

With the cycling shoe system according to the third aspect, the user can manually tighten the closure to a level that is suitable for the rider.

In accordance with a fourth aspect of the present disclosure, the cycling shoe system according to any one of the first aspect to the third aspect is configured so that the closure includes a strap tightener and a shoe strap extending between the first portion and the second portion.

With the cycling shoe system according to the fourth aspect, the first portion and the second portion can be reliably coupled together in an adjustable manner.

In accordance with a fifth aspect of the present disclosure, the cycling shoe system according to any one of the first aspect to the fourth aspect is configured so that the closure includes at least one reel based closure.

With the cycling shoe system according to the fifth aspect, the closure can be easily operated to adjust the tightness level using at least one reel based closure In accordance with a sixth aspect of the present disclosure, the cycling shoe system according to any one of the first aspect to the fifth aspect is configured so that the controller is configured to control the actuator to adjust the tightening force to the target tightening force based the bicycle information.

With the cycling shoe system according to the sixth aspect, the tightening force applied by the closure can be adjusted to the target tightening force based the bicycle information.

In accordance with a seventh aspect of the present disclosure, the cycling shoe system according to any one of the first aspect to the sixth aspect is configured so that the bicycle information includes at least one of a forward speed, a pedaling cadence, a pedaling input power, and global positioning coordinates.

With the cycling shoe system according to the seventh aspect, the tightening force applied by the closure can be adjusted based on at least one of a forward speed, a pedaling cadence, a pedaling input power, and global positioning coordinates.

In accordance with an eighth aspect of the present disclosure, the cycling shoe system according to any one of the first aspect to the seventh aspect is configured so that the controller is configured to control the actuator to adjust the tightening force to the target tightening force based the user information.

With the cycling shoe system according to the eighth aspect, the tightening force applied by the closure can be adjusted based on the user information.

In accordance with a ninth aspect of the present disclosure, the cycling shoe system according to the eighth aspect is configured so that the user information includes one of a shoe condition and user condition.

With the cycling shoe system according to the ninth aspect, the tightening force applied by the closure can be adjusted based on at least one of a shoe condition and user condition.

In accordance with a tenth aspect of the present disclosure, the cycling shoe system according to the ninth aspect is configured so that the shoe condition includes at least one of a shoe temperature, an insole pressure, humidity, and a preset initial tightening force setting.

With the cycling shoe system according to the tenth aspect, the tightening force applied by the closure can be adjusted based on at least one of a shoe temperature, an insole pressure, humidity, and a preset initial tightening force setting.

In accordance with an eleventh aspect of the present disclosure, the cycling shoe system according to the ninth aspect is configured so that the user condition includes at least one of heart rate, body temperature, blood oxygen concentration and blood lactate level.

With the cycling shoe system according to the eleventh aspect, the tightening force applied by the closure can be adjusted based on at least one of heart rate, body temperature, blood oxygen concentration and blood lactate level.

In accordance with a twelfth aspect of the present disclosure, the cycling shoe system according to any one of the first aspect to the eleventh aspect further comprises a second sensor configured to detect user information. The controller is configured to control the actuator to adjust the tightening force to the target tightening force based on the user information.

With the cycling shoe system according to the twelfth aspect, the tightening force applied by the closure can be adjusted based on user information using a sensor.

In accordance with a thirteenth aspect of the present disclosure, the cycling shoe system according to any one of the first aspect to the twelfth aspect is configured so that the controller is configured to control the actuator to adjust the tightening force to one of a first force corresponding to a preset initial tightening force setting and a second force corresponding to an initial manual user setting upon establishing between the communicator and at least one of a bicycle and an external device.

With the cycling shoe system according to the thirteenth aspect, the tightening force applied by the closure can be adjusted to either a preset initial tightening force setting or an initial manual user setting.

In accordance with a fourteenth aspect of the present disclosure, the cycling shoe system according to any one of the first aspect to the thirteenth aspect further comprises a storage device having stored one or more tightening force settings corresponding to at least one of the bicycle information and the user information.

With the cycling shoe system according to the fourteenth aspect, tightening force settings can be easily saved for future use in a storage device.

In accordance with a fifteenth aspect of the present disclosure, the cycling shoe system according to any one of the first aspect to the fourteenth aspect is configured so that the communicator is a wireless communicator.

With the cycling shoe system according to the fifteenth aspect, the actuator and the controller can be conveniently located without using an electrical cable to receive data.

In accordance with a sixteenth aspect of the present disclosure, the cycling shoe system according to any one of the first aspect to the fifteenth aspect further comprises a first power source.

With the cycling shoe system according to the sixteenth aspect, it is possible to easily provide electric power to the cycling shoe system.

In accordance with a seventeenth aspect of the present disclosure, the cycling shoe system according to any one of the first aspect to the sixteenth aspect is configured so that the first power source is a rechargeable battery.

With the cycling shoe system according to the seventeenth aspect, the costs for new batteries can be minimized by using a rechargeable battery.

In accordance with an eighteenth aspect of the present disclosure, the cycling shoe system according to any one of the first aspect to the seventeenth aspect further comprises a non-contact charging coil configured to wirelessly receive electric power from a second power source, and to supply the electric power to the first power source.

With the cycling shoe system according to the eighteenth aspect, the power source of the cycling shoe system can be easily recharged without having to remove the power source.

In accordance with a nineteenth aspect of the present disclosure, the cycling shoe system according to any one of the first aspect to the eighteenth aspect is configured so that the closure includes a first closure that is automatically operated by the controller, and a second closure that is manually operated.

With the cycling shoe system according to the nineteenth aspect, the tightness level of the upper can be adjusted either automatically or manually as needed and/or desired by the user.

In accordance with a twentieth aspect of the present disclosure, a cycling shoe system is provided that basically comprises an upper, a sole, a closure, an actuator, a communicator and a controller. The upper has a first portion, a second portion, and an opening between the first portion and the second portion. The sole is attached to the upper. The closure is coupled between the first portion and the second portion. The actuator operatively coupled to the closure to adjust a relative position of the first portion and the second portion. The communicator is configured to receive first information from an external device. The controller is configured to control the actuator to adjust a tightening force applied by the closure to a target tightening force based on at least one of the first information and a second information relating to a shoe condition.

With the cycling shoe system according to the twentieth aspect, it is possible to adjust a tightening force to be applied by the closure based on at least one of the first information from an external device and the second information relating to a shoe condition.

Also, other objects, features, aspects and advantages of the disclosed cycling shoe system will become apparent to those skilled in the art from the following detailed description, which, taken in conjunction with the annexed drawings, discloses preferred embodiments of the cycling shoe system.

BRIEF DESCRIPTION OF THE DRAWINGS

Referring now to the attached drawings which form a part of this original disclosure.

DETAILED DESCRIPTION OF EMBODIMENTS

Selected embodiments will now be explained with reference to the drawings. It will be apparent to those skilled in the bicycle field from this disclosure that the following descriptions of the embodiments are provided for illustration only and not for the purpose of limiting the invention as defined by the appended claims and their equivalents.

Figure 1:
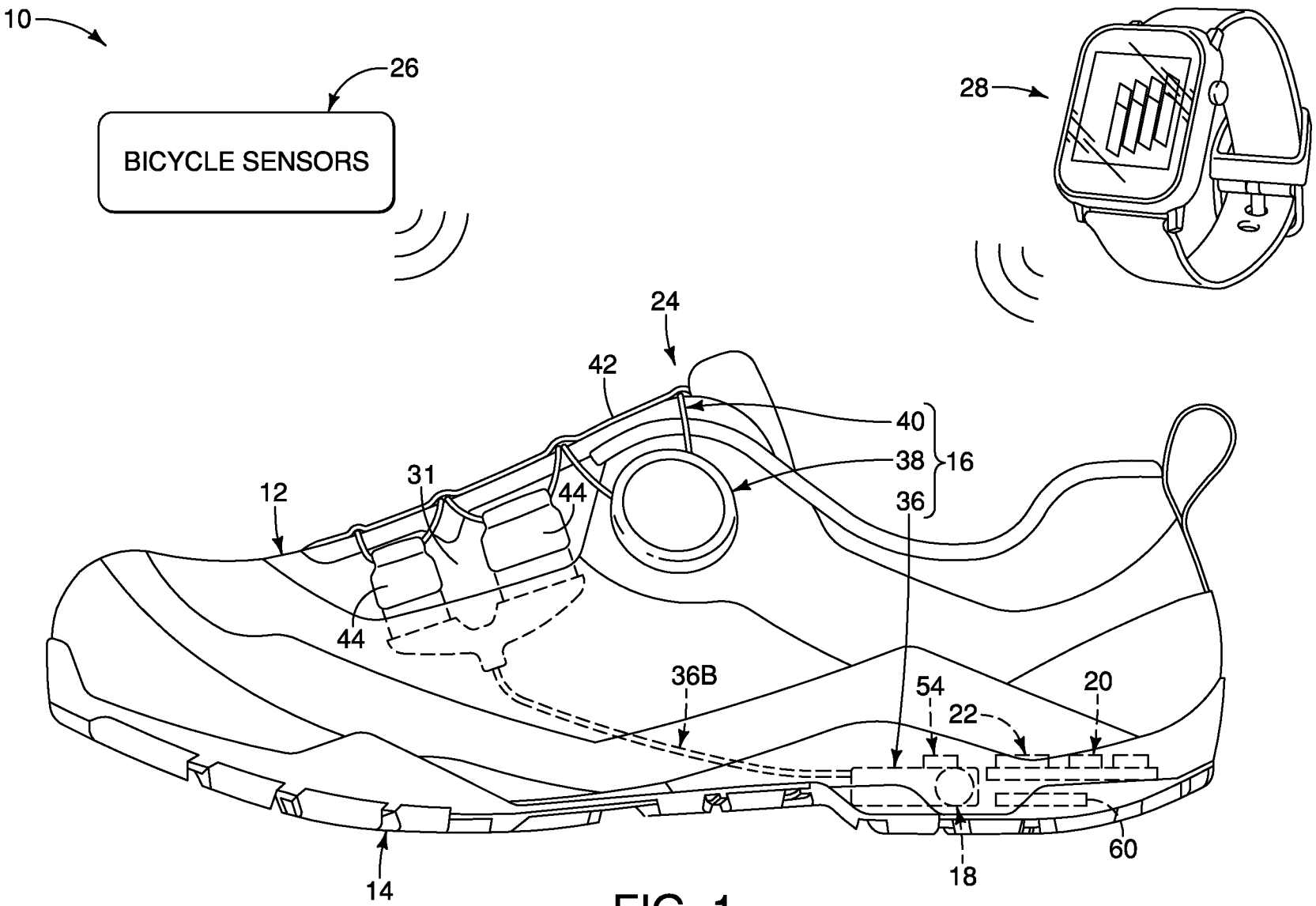
FIG. 1 is a side elevational view of a cycling shoe system in accordance with one embodiment.

Referring initially to FIG. 1, a cycling shoe system 10 is illustrated in accordance with a first embodiment. The cycling shoe system 10 basically comprises an upper 12, a sole 14, a closure 16, an actuator 18, a communicator 20 and a controller 22. The sole 14 is attached to the upper 12. Thus, the upper 12 and the sole 14 form a cycling shoe 24. Here, the cycling shoe 24 is a left cycling shoe. Preferably, a right cycling shoe is provided that has the same configuration or substantially the same configuration as the cycling shoe 24, except that the cycling shoe 24 is a mirror image of the cycling shoe 24.

Basically, in the cycling shoe system 10, the controller 22 is configured to control the actuator 18 to adjust a tightening force applied by the closure 16 to a target tightening force based on at least one of the bicycle information and the user information. Preferably, the bicycle information includes at least one of a forward speed, a pedaling cadence, a pedaling input power, and global positioning coordinates. On the other hand, the user information includes at least one of a shoe condition and user condition. Preferably, the shoe condition includes at least one of a shoe temperature, an insole pressure, humidity, and a preset initial tightening force setting. Preferably, the user condition includes at least one of heart rate, body temperature, blood oxygen concentration and blood lactate level.

Figure 4:
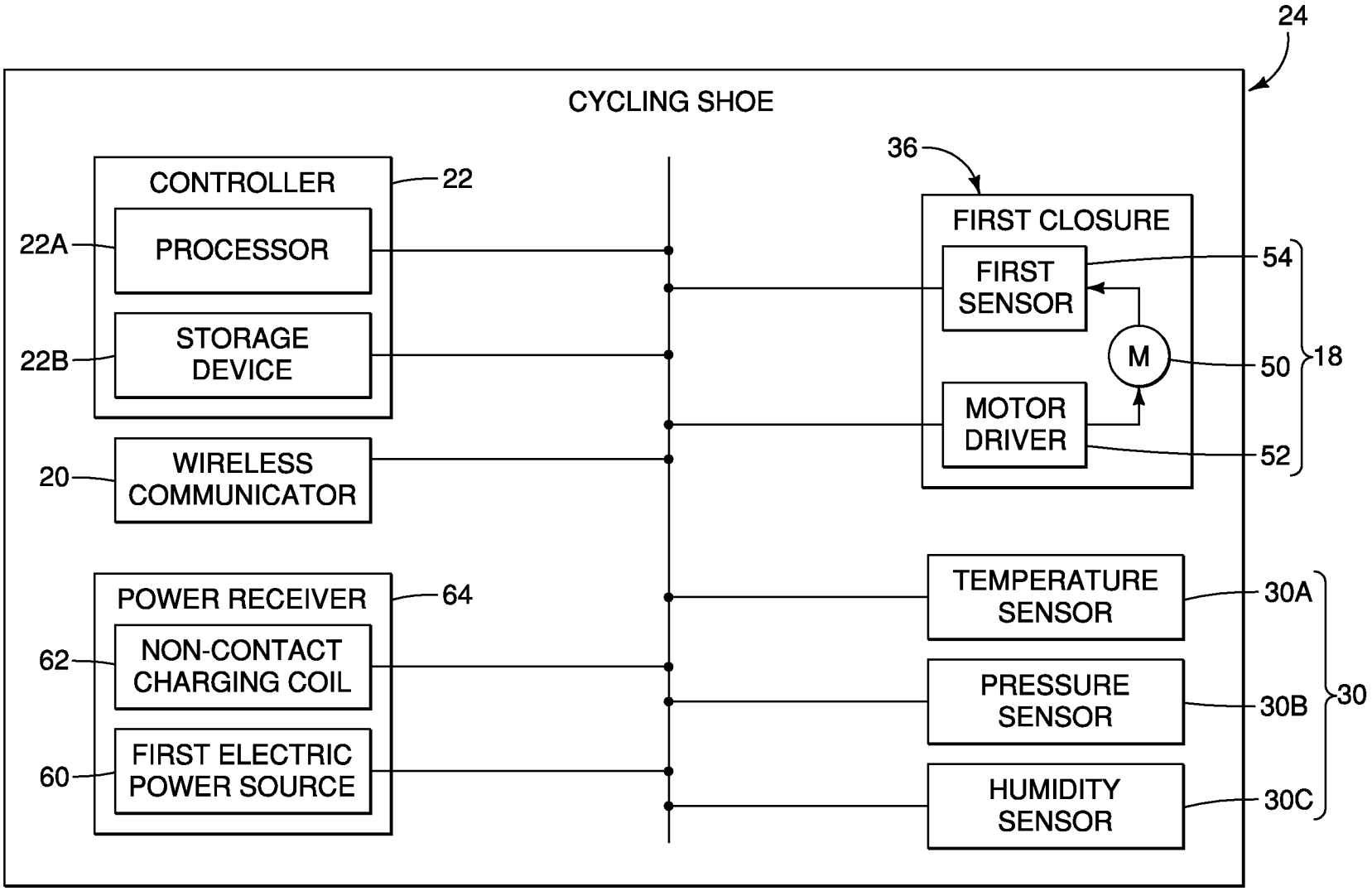
FIG. 4 an overall schematic block diagram showing an electrical configuration of the cycling shoe system illustrated in FIG. 1.

As seen in FIG. 4, the controller 22 includes at least one processor 22A that executes a predetermined control program. The at least one processor 22A can be for example, a central processing unit (CPU) or a micro processing unit (MPU). The controller 22 can include processors provided at positions separate from each other. The controller 22 can include one or more microcomputers. The controller 22 is formed of one or more semiconductor chips that are mounted on a circuit board. Thus, the controller 22 is an electronic controller. The term "electronic controller" as used herein refers to hardware that executes a software program, and does not include a human. The processor 22A includes, for example, an arithmetic processing unit. While only one processor is illustrated in FIG. 4, it will be apparent from this disclosure that several processors can be used. When several processors are used, the processors can be provided at different positions separate from each other.

As seen in FIG. 4, preferably, the controller 22 further includes a data storage device 22B. Alternatively, the data storage device 22B can be remotely located from the controller 22. Thus, the cycling shoe system 10 further comprises the storage device 22B. The data storage device 22B stores various control programs and information used for various control processes. Moreover, the storage device 22B has stored one or more tightening force settings corresponding to at least one of the bicycle information and the user information. The data storage device 22B includes any computer storage device or any non-transitory computer-readable medium with the sole exception of a transitory, propagating signal. For example, the data storage device 22B includes a nonvolatile memory and a volatile memory. The nonvolatile memory includes, for example, at least one of a read-only memory (ROM), an erasable programmable read only memory (EPROM), an electrically erasable programmable read-only memory (EEPROM), and a flash memory. The volatile memory includes, for example, a random access memory (RAM).

In the illustrated embodiment, the cycling shoe system 10 further comprises a plurality of bicycle sensors 26 for providing the bicycle information of the bicycle that is being ridden by a rider wearing the cycling shoe 24. Thus, the controller 22 is configured to control the actuator 18 to adjust the tightening force to the target tightening force based the bicycle information. In this way, the tightening force applied by the closure 16 is controlled based on the bicycle information of the bicycle being ridden by a rider wearing the cycling shoe 24. Of course, it will be apparent from this disclosure that the bicycle information can include other bicycle information relating to a traveling condition of the bicycle. In the illustrated embodiment, the cycling shoe system 10 further comprises a user physical fitness monitor 28 for providing the user information of the a rider wearing the cycling shoe 24. The user physical fitness monitor 28 is preferably configured to detect heart rate, body temperature, blood oxygen concentration and blood lactate level of the user. Thus, the controller 22 is configured to control the actuator 18 to adjust the tightening force to the target tightening force based the user information.

The cycling shoe system 10 further comprises a second sensor 30. The second sensor 30 is configured to detect user information. More specifically, the second sensor 30 detects at least one shoe condition of the cycling shoe 24 that affects a user wearing the cycling shoe 24. In other words, shoe condition is a type of user information. Here, as seen in FIG. 4, the second sensor 30 includes a temperature sensor 30A, a pressure sensor 30B and a humidity sensor 30C. The temperature sensor 30A is configured to detect an inside shoe temperature that the user's foot is subjected to when wearing the cycling shoe 24. The pressure sensor 30B is configured to sole pressure of the user's foot against the interior surface of the sole 14 of the cycling shoe 24. The humidity sensor 30C is configured to detect humidity inside of the cycling shoe 24, and thus, the humidity that the user's foot is subjected to when wearing the cycling shoe 24.

Preferably, the target tightening forces are preset by the manufacturer for various conditions based on the bicycle information and/or the user information. Also, preferably, a user can override the manufacturer settings by manually inputting new user preset settings. The amount of adjustment can be set by a user using an external device such as a mobile phone, a computer tablet and/or a personal computer. For example, the controller 22 is configured to control the actuator 18 to adjust the tightening force to one of a first force corresponding to a preset initial tightening force setting and a second force corresponding to an initial manual user setting upon establishing between the communicator 20 and at least one of a bicycle and an external device. Of course, preferably, there is a reset feature for restoring the manufacturer settings.

In any case, various target tightening adjustments can be prestored in the data storage device 22B for adjusting the tightness of the upper 12 on the user's foot in accordance with various conditions based on the bicycle information and/or the user information. The controller 22 is configured to control the actuator 18 to adjust the tightening force in accordance with the prestored target tightening adjustments. The following Table 1 shows examples of some of the prestored adjustments to the target tightening adjustments with respect to selected bicycle information and selected user information.

TABLE 1

| | Bicycle Information And User Information | | | | | Output To |
|---|---|---|---|---|---|---|
| | Forward Speed | GPS | Cadence | Pedal Input Power | Shoe Temperature | Shoe Closure Adjustment |
| Initial Setting | Any | Any | Any | Any | Any | No Adjustment |
| Setting 1 | Over 20 km/h | Paved Path | Over 80 rpm | Over 150 w | Any | Tighten Shoe |
| Setting 2 | Over 20 km/h | Paved Path | Any | Under 100 w | Any | Loosen Shoe |
| Setting 3 | Any | Off Road | Any | Any | Any | No Adjustment |
| Setting 4 | Any | Any | Under 60 Rpm | Under 100 w | 35.5° C. | Loosen Shoe |
| • | • | • | • | • | • | • |
| • | • | • | • | • | • | • |
| • | • | • | • | • | • | • |

Here, the communicator 20 is configured to carrying out the communications between the controller 22 and the bicycle sensors 26. Also, the communicator 20 is configured to carrying out the communications between the controller 22 and the physical fitness monitor 28. Moreover, the communicator 20 is configured to carrying out the communications between the controller 22 and the second sensor 30. Thus, the communicator 20 is configured to receive at least one of bicycle information and user information. Preferably, the communicator 20 is configured to receive both the bicycle information and the user information. Of course, depending on the configuration of cycling shoe system 10, the communicator 20 may only receive either the bicycle information or the user information.

Alternatively, the information that is received by the communicator 20 can be considered first information relating to information other than a shoe condition, and second information relating to a shoe condition. For example, the communicator 20 is configured to receive first information from an external device. The external device can be, for example, one or more of the bicycle sensors 26 and/or the physical fitness monitor 28. Also, the external device can be a mobile phone, a computer tablet and/or a personal computer.

Thus, the first information can include the bicycle information and/or the user information other than a shoe condition. On the other hand, the communicator 20 is configured to receive second information relating to a shoe condition from the second sensor 30 (e.g., the temperature sensor 30A, the pressure sensor 30B and the humidity sensor 30C). In this case, the controller 22 is configured to control the actuator 18 to adjust a tightening force applied by the closure 16 to a target tightening force based on at least one of the first information and the second information relating to a shoe condition.

As seen in FIG. 4, the communicator 20 is configured to carrying out the communications with the second sensor 30 by wired communication such as by a dedicated signal wire or by a power wire using power line communication (PLC). On the other hand, the communicator 20 is configured to carrying out the communications with the bicycle sensors 26 and the physical fitness monitor 28 using wireless signals. Thus, the communicator 20 includes a wireless communication circuit and a wired communication circuit. Thus, the wired communication circuit of the communicator 20 can be considered to be a wired communicator that is configured to conduct wired communications with the second sensor 30.

The wireless communication circuit of the communicator 20 is a wireless communicator. In other words, the wireless communication circuit of the communicator 20 is configured to wirelessly communicate with the bicycle sensors 26 to wirelessly receive the bicycle information and the physical fitness monitor 28 to wirelessly receive the user information. The term "wireless communicator" as used herein includes a receiver, a transmitter, a transceiver, a transmitter-receiver, and contemplates any device or devices, separate or combined, capable of transmitting and/or receiving wireless communication signals. Here, the communicator 20 can be a receiver that receives the bicycle information and/or the use information. The wireless communication signals can be radio frequency (RF) signals, ultra-wide band communication signals, radio frequency identification (RFID), ANT+ communications, or Bluetooth® communications or any other type of signal suitable for short range wireless communications as understood in the bicycle field.

Figure 2:
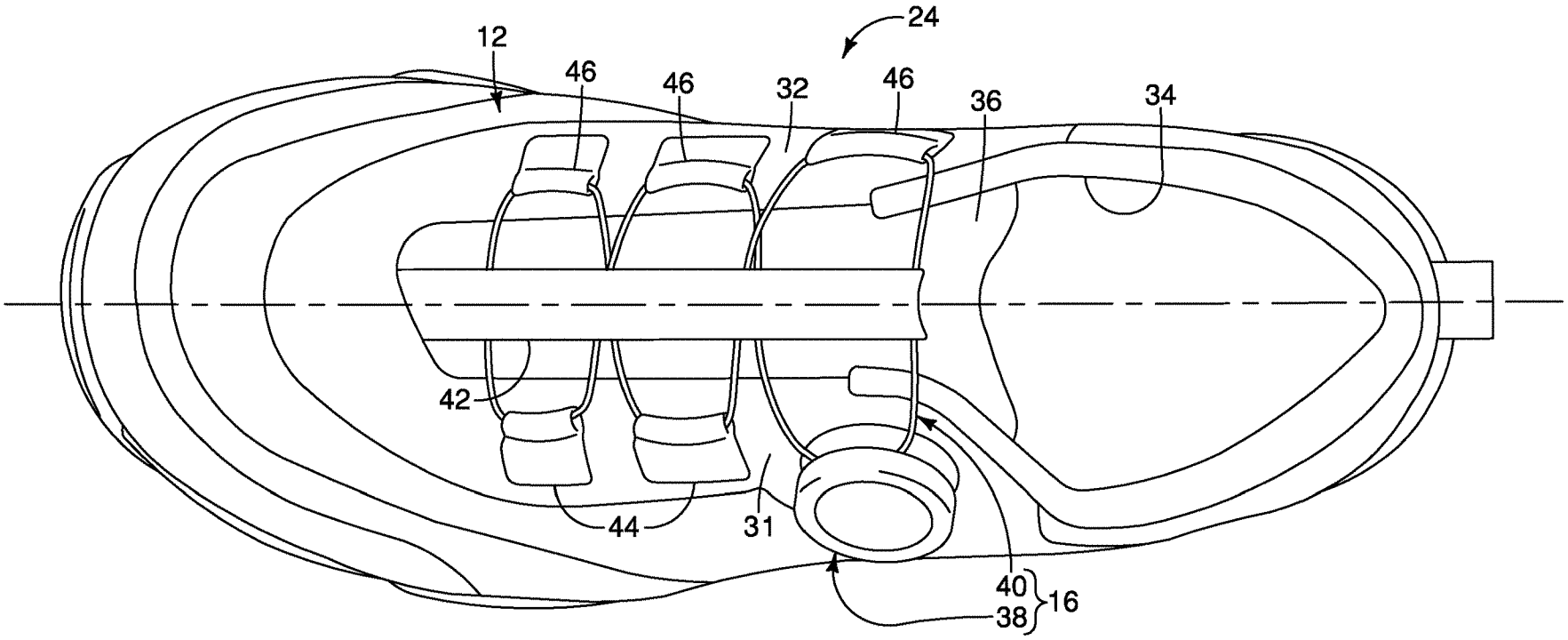
FIG. 2 is a top plan view of the cycling shoe illustrated in FIG. 1.

As seen in FIG. 2, the upper 12 has a first portion 31, a second portion 32 and an opening 34 between the first portion 31 and the second portion 32. Here, the upper 12 has a tongue portion 36 located between the first portion 31 and the second portion 32. The closure 16 is coupled between the first portion 31 and the second portion 32. In the illustrated embodiment, the closure 16 includes at least one reel based closure. Preferably, the closure 16 includes a first closure 36 that is automatically operated by the controller 22, and a second closure 38 that is manually operated. The first closure 36 and the second closure 38 are both reel based closures in the illustrated embodiment. It will be apparent that the second closure 38 (i.e., the manually operated closure) can be omitted if needed and/or desired. Moreover, the location and configurations of the first closure 36 and the second closure 38 can be changed as needed and/or desired so long as they can carry out the tightening of the upper 12.

In any case, the closure 16 includes a strap tightener (the first closure 36 and/or the second closure 38) and a shoe strap 40 extending between the first portion 31 and the second portion 32. Here, the strap tightener (the first closure 36 and/or the second closure 38) is a reel based tightener and the shoe strap 40 is a cord. The tongue portion 36 is provided with a guide 42 for receiving the shoe strap 40. The first portion 31 of the upper 12 has two first guides 44 for receiving the shoe strap 40. The second portion 32 of the upper 12 has three second guides 46 for receiving the shoe strap 40. The shoe strap 40 extends through the first guides 44 and the second guides 46. The strap tightener (the first closure 36 and/or the second closure 38) is configured to selectively wind the shoe strap 40 to tighten the upper 12 on the user's foot, and is configured to unwind the shoe strap 40 to loosen the upper 12 on the user's foot. In the illustrated embodiment, the strap tightener 40 of the closure 16 is configured to be manually tightened.

Figure 3:
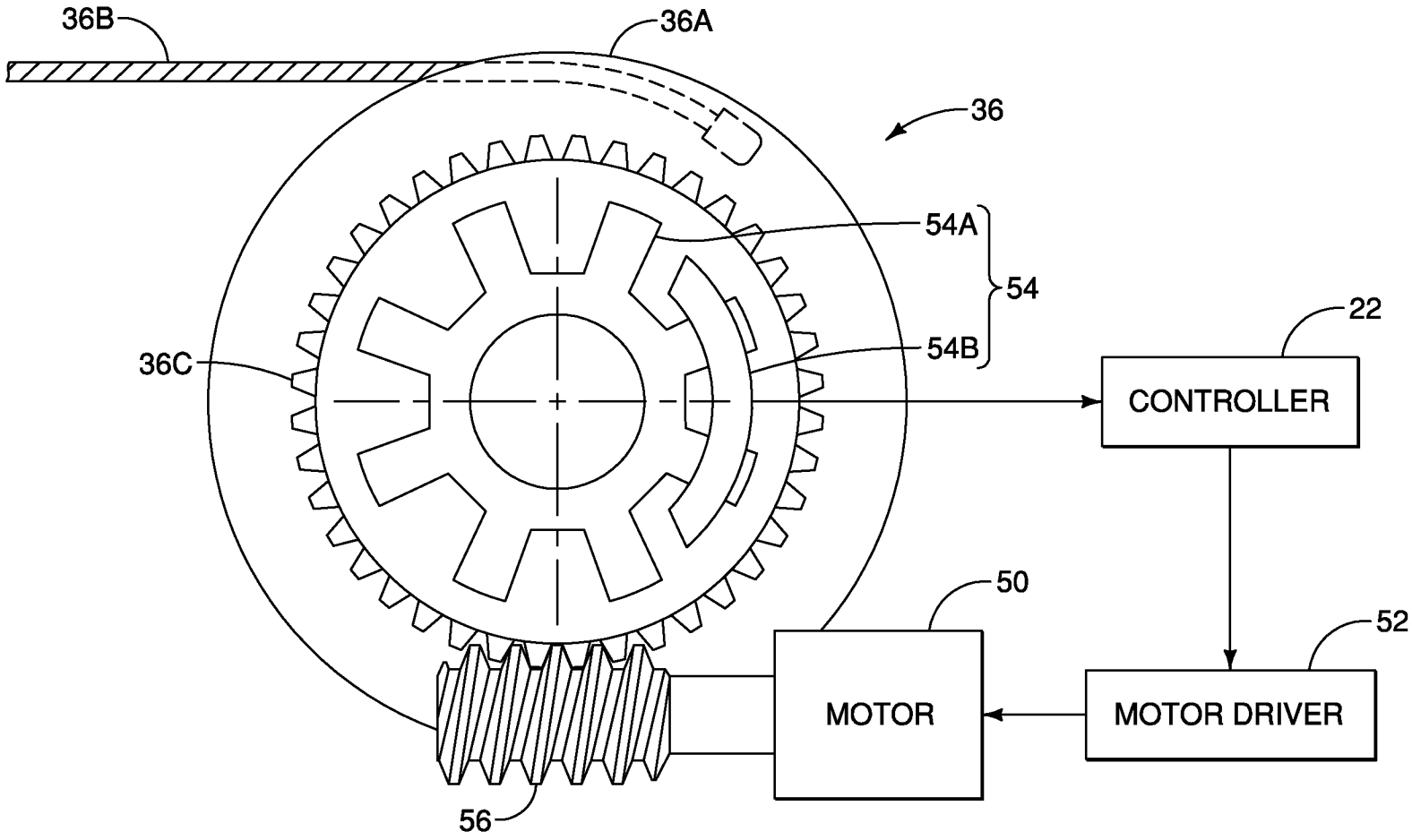
FIG. 3 is a schematic diagram of a reel based closure of the cycling shoe system illustrated in FIG. 1.

As seen in FIG. 3, the first closure 36 includes a reel 36A and a cable 36B. The cable 36B has a first end coupled to the reel 36A such that the cable 36B can be wound onto the reel 36A to tighten the upper 12 on the user's foot and unwound from the reel 36A to loosen the upper 12 on the user's foot. As seen in FIG. 1, the cable 36B has a second end coupled to the first guides 44 for moving the first guides 44 with respect to the first portion 31 of the upper 12. In this way, the shoe strap 40 is selectively pulled and released in response to the operation of the first closure 36.

The actuator 18 is operatively coupled to the closure 16 to adjust a relative position of the first portion 31 and the second portion 32. Here, as seen in FIGS. 3 and 4, the actuator 18 includes a motor 50 and a motor driver 52. The motor 50 is controlled by the a motor driver 52 in response to commands received from the controller 22. The cycling shoe system 10 further comprises a first sensor 54 that is configured to detect the tightening force applied to the upper 12 between the first portion 31 and the second portion 32. Thus, the controller 22 controls the motor 50 based on detection results of the first sensor 54. Here, the motor 50 rotates a worm gear 56 that is engaged with a gear 36C of the first closure 36. The gear 36C is mounted to the reel 36A such that the reel 36A and the gear 36C rotate together. Thus, rotation of the motor 50 is transmitted to the reel 36A via the worm gear 56 and the gear 36C.

The first sensor 54 is basically a position sensor such as a potentiometer, a photo interrupter, a rotation sensor, and a rotary encoder. Here, the first sensor 54 is illustrated as a rotary encoder that detects a rotation position of the reel 36A. The first sensor 54 basically includes a detected part 54A and a detector 54B. The detected part 54A is mounted to the reel 36A or the gear 36C to rotate therewith. The detector 54B is mounted to stationary part (e.g., a housing) of the closure 16. The detected part 54A can be, for example, a series of magnetic poles, and the detector 54B can be, for example, magneto-resistive or Hall Effect detector. The term "sensor" as used herein also refers to a hardware device or instrument designed to detect the presence of a particular object or substance and to emit a signal in response. The term "sensor" as used herein also do not include a human.

Referring to FIG. 4, the cycling shoe system 10 further comprises a first power source 60. Here, the first power source 60 is a rechargeable battery. Alternatively, the first power source 60 can be a replaceable battery such as one or more button batteries. In the illustrated embodiment, the cycling shoe system 10 further comprises a non-contact charging coil 62. In this way, the first power source 60 can be recharged from electric power from the non-contact charging coil 62. Alternatively, or in addition, the cycling shoe 24 can be provided with a charging port for receiving electric power via a power cable. The first power source 60 and the non-contact charging coil 62 form a power receiver for wirelessly receiving electric power without physically contacting a charger.

Figure 5:
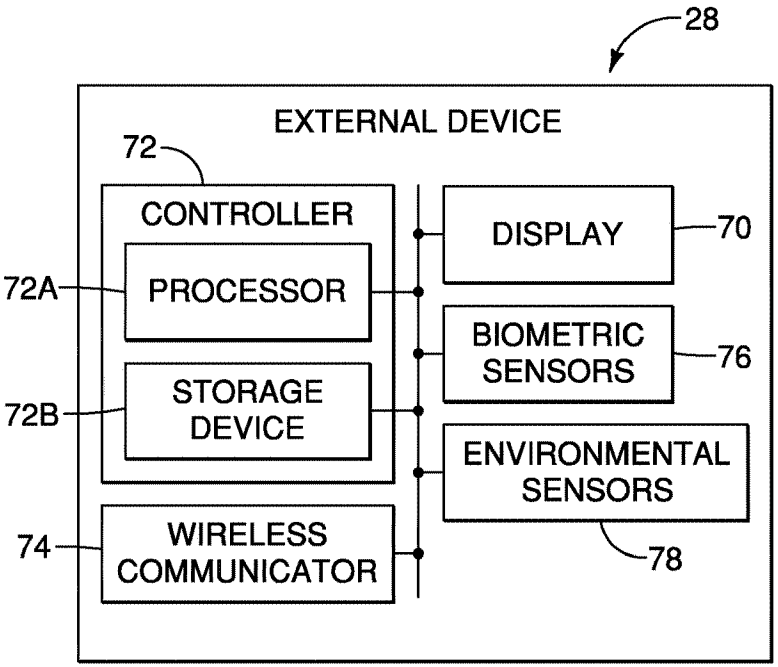
FIG. 5 is a schematic diagram of an external device of the cycling shoe system illustrated in FIG. 1.

Referring now to FIG. 5, the physical fitness monitor 28 will now be discussed in more detail. As mentioned above, the physical fitness monitor 28 is an example of an external device. Physical fitness monitors such as the physical fitness monitor 28 as well known. Here, the physical fitness monitor 28 is designed to be worn on a user's wrist. The physical fitness monitor 28 includes a display 70 for displaying various information to a user. The display 70 is preferably a touch screen that functions as a user input.

The physical fitness monitor 28 further includes a controller 72 includes at least one processor 72A that executes a predetermined control program. The at least one processor 72A can be for example, a central processing unit (CPU) or a micro processing unit (MPU). Thus, the controller 72 is an electronic controller. The controller 72 further includes data storage device 72B. The data storage device 72B stores various control programs and information used for various control processes. The data storage device 72B includes any computer storage device or any non-transitory computer-readable medium with the sole exception of a transitory, propagating signal. For example, the data storage device 72B includes a nonvolatile memory and a volatile memory.

The physical fitness monitor 28 further includes a communicator 74 which is a wireless communicator. The communicator 74 is configured to wirelessly communicate with the communicator 20 of the cycling shoe 24. Thus, the communicator 74 wirelessly communicates the user information to the controller 22 of the cycling shoe 24. More specifically, the physical fitness monitor 28 includes a plurality of biometer sensors 76 and a plurality of environmental sensors 78. The biometer sensors 76 include a heart rate sensor, a body temperature sensor, a blood oxygen concentration sensor and a blood lactate level sensor. The environmental sensors 78 include an air temperature sensor and a humidity sensor.

Figure 6:
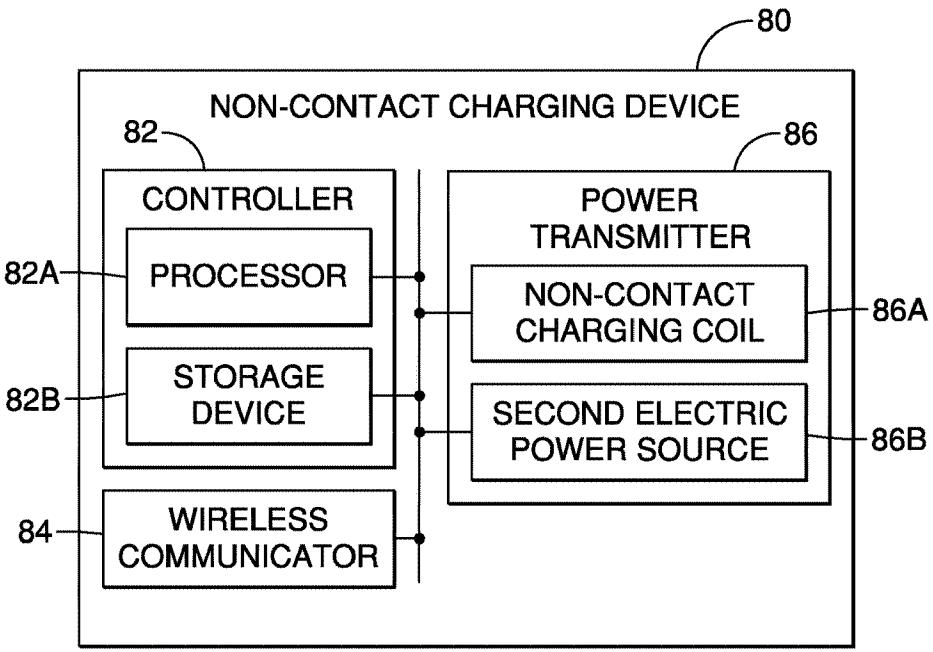
FIG. 6 is a schematic diagram of a non-contact charging device of the cycling shoe system illustrated in FIG. 1.

Referring now to FIG. 6, a non-contact charging device 80 is diagrammatically illustrated. The non-contact charging device 80 basically includes a controller 82, a communicator 84 and a power transmitter 86. The non-contact charging device 80 is configured to wirelessly transmit electric power to the cycling shoe 24. More specifically, the non-contact charging device 80 is configured to wirelessly transmit electric power to the non-contact charging coil 62 of the cycling shoe 24.

The controller 82 includes at least one processor 82A and a data storage device 82B. The at least one processor 82A can be for example, a central processing unit (CPU) or a micro processing unit (MPU). The controller 82 can include one or more microcomputers. The controller 82 is formed of one or more semiconductor chips that are mounted on a circuit board. Thus, the controller 82 is an electronic controller. The data storage device 82B stores various control programs and information used for various control processes. The data storage device 82B includes any computer storage device or any non-transitory computer-readable medium with the sole exception of a transitory, propagating signal. For example, the data storage device 22B includes a nonvolatile memory and a volatile memory.

The communicator 84 is a wireless communicator for wirelessly communicating with the communicator 20 of the cycling shoe 24 for controlling the recharging of the first power source 60. Preferably, the wireless communicator 82 is a two-way wireless communicator (e.g., a transceiver) in that information is preferably exchanged between the communicator 20 of the cycling shoe 24 and the communicator 84 such as connection, charging and discharging status.

The power transmitter 86 basically includes a non-contact charging coil 86A and a second power source 86B. The non-contact charging coil 86A is configured to wirelessly transmit the electric power from the second power source 86B to the non-contact charging coil 62 of the cycling shoe 24. Thus, the non-contact charging coil 62 is configured to wirelessly receive electric power from the second power source 86B, and to supply the electric power to the first power source 60. The non-contact charging coils 62 and 86A can use magnetic resonance which can transmit electric power up one or two meters.

Figure 7:
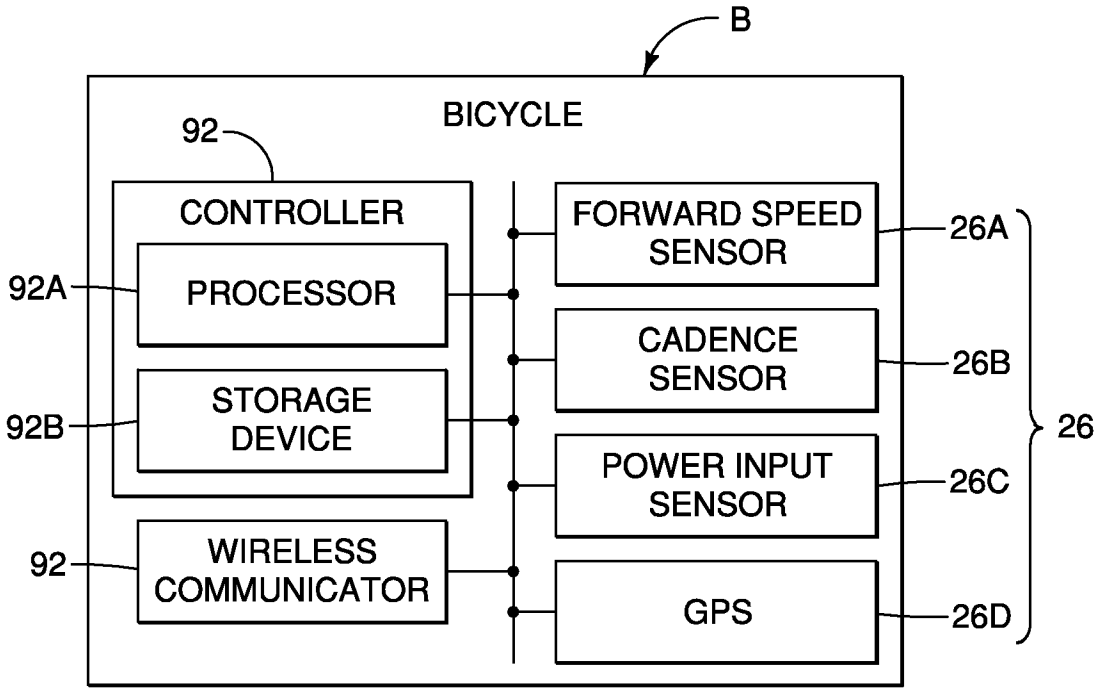
FIG. 7 is a schematic diagram of a various components of the cycling shoe system that are located on the bicycle.

Referring now to FIG. 7, parts of a bicycle B that relate to the cycling shoe system 10 are diagrammatically illustrated. The bicycle B is provided with a controller 92 and a communicator 94. The controller 92 communicates with the bicycle sensors 26 and the communicator 92. The communicator 94 communicates with the cycling shoe 24. The controller 92 and the communicator 94 can be separate components or can be integrated into a single component. For example, the controller 92 and the communicator 94 can be integrated into a cycle computer as in the illustrated embodiment.

Here, the bicycle sensors 26 include a forward speed sensor 26A, a pedaling cadence sensor 26B, a pedaling input sensor 26C and a GPS sensor 26D. The controller 92 receives input signals from the bicycle sensors 26, and controls the communicator 94 to wirelessly transmit the bicycle information from the bicycle sensors 26 to the cycling shoe 24. The forward speed sensor 26A is configured to detect information corresponding to a forward speed of the bicycle B. The cadence sensor 26B is configured to detect information corresponding to a rotational speed of a crank axle of the bicycle B. The pedaling input sensor 26C is configured to detect information corresponding to a torque applied to a crank of the bicycle B by a human driving force. The GPS sensor 26D is configured to detect information corresponding to global positioning coordinates of the bicycle B.

The controller 92 includes at least one processor 92A and a data storage device 92B. The at least one processor 92A can be for example, a central processing unit (CPU) or a micro processing unit (MPU). The controller 92 can include one or more microcomputers. The controller 92 is formed of one or more semiconductor chips that are mounted on a circuit board. Thus, the controller 92 is an electronic controller. The data storage device 92B stores various control programs and information used for various control processes. The data storage device 92B includes any computer storage device or any non-transitory computer-readable medium with the sole exception of a transitory, propagating signal. For example, the data storage device 92B includes a nonvolatile memory and a volatile memory.

The communicator 94 is a wireless communicator 92 for wirelessly communicating with the communicator 20 of the cycling shoe 24 for controlling the recharging of the first power source 60. Preferably, the wireless communicator 92 can be either a one-way communicator or a two-way wireless communicator. For example, the wireless communicator 92 can be a transmitter that transmits the bicycle information to the communicator 20 of the cycling shoe 24, or a transceiver that sends and receives signals.

Figure 8:
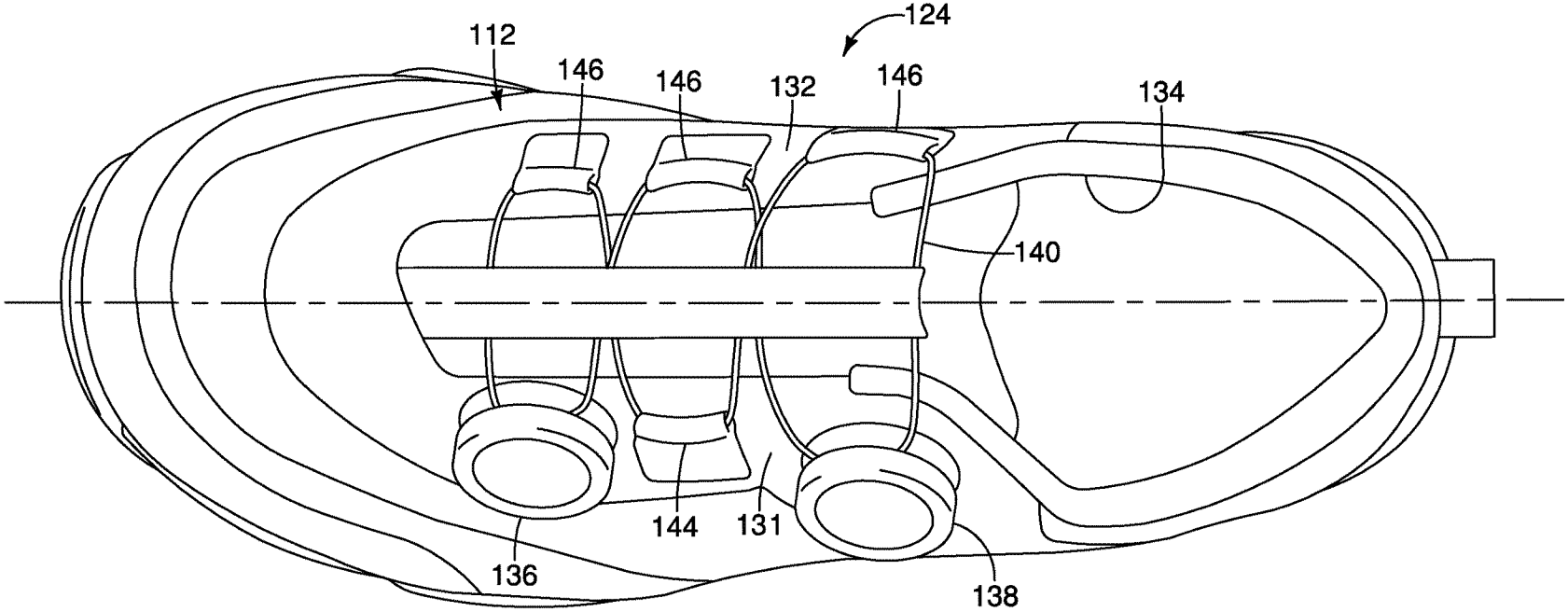
FIG. 8 is a top plan view of a cycling shoe in accordance with another embodiment.

Referring now to FIG. 8, a cycling shoe 124 is illustrated in accordance with a second embodiment. The cycling shoe 124 includes an upper 112 that is identical to the upper 12. Thus, the upper 112 has a first portion 131, a second portion 132 and an opening 134 between the first portion 131 and the second portion 132. However, here, the upper 112 is provided with a first closure 136 that is automatically operated, and a second closure 138 that is manually operated. The first closure 136 and the second closure 138 are both reel based closures in the illustrated embodiment that wind and unwind a shoe strap 140. The first closure 136 is operatively coupled to a controller in the same manner as in the first embodiment. Thus, the upper 112 can be automatically tightened based on bicycle information and/or user information in the same manner as the upper 12 of the cycling shoe 24.

Accordingly, the main difference between the cycling shoe 24 and the cycling shoe 124 is location of the automatically operated (first) closure. In particular, in the cycling shoe 124, the first closure 136 and the second closure 138 are provided to the first portion 131 of the upper 112 for directly winding and un winding shoe strap 140. The first portion 131 of the upper 112 has a first guide 144 for receiving the shoe strap 140. The second portion 132 of the upper 112 has second guides 146 for receiving the shoe strap 140. The shoe strap 140 extends through the first guide 144 and the second guide 46. The first closure 136 and the second closure 138 are configured to selectively and independently wind the shoe strap 140 to tighten the upper 112 on the user's foot.

In view of the similarities between the cycling shoe 24 and the cycling shoe 124, for the sake of brevity, the cycling shoe 124 will not be described in further detail. Rather, the description of the cycling shoe 24 can be used to readily understand the cycling shoe 124.

In understanding the scope of the present invention, the term "comprising" and its derivatives, as used herein, are intended to be open ended terms that specify the presence of the stated features, elements, components, groups, integers, and/or steps, but do not exclude the presence of other unstated features, elements, components, groups, integers and/or steps. The foregoing also applies to words having similar meanings such as the terms, "including", "having" and their derivatives. Also, the terms "part," "section," "portion," "member" or "element" when used in the singular can have the dual meaning of a single part or a plurality of parts unless otherwise stated.

As used herein, the following directional terms "frame facing side", "non-frame facing side", "forward", "rearward", "front", "rear", "up", "down", "above", "below", "upward", "downward", "top", "bottom", "side", "vertical", "horizontal", "perpendicular" and "transverse" as well as any other similar directional terms refer to those directions of a bicycle in an upright, riding position or the cycling shoe in resting in a horizontal position.

The phrase "at least one of" as used in this disclosure means "one or more" of a desired choice. For one example, the phrase "at least one of" as used in this disclosure means "only one single choice" or "both of two choices" if the number of its choices is two. For another example, the phrase "at least one of" as used in this disclosure means "only one single choice" or "any combination of equal to or more than two choices" if the number of its choices is equal to or more than three. Also, the term "and/or" as used in this disclosure means "either one or both of".

Also, it will be understood that although the terms "first" and "second" may be used herein to describe various components, these components should not be limited by these terms. These terms are only used to distinguish one component from another. Thus, for example, a first component discussed above could be termed a second component and vice versa without departing from the teachings of the present invention.

The term "attached" or "attaching", as used herein, encompasses configurations in which an element is directly secured to another element by affixing the element directly to the other element; configurations in which the element is indirectly secured to the other element by affixing the element to the intermediate member(s) which in turn are affixed to the other element; and configurations in which one element is integral with another element, i.e. one element is essentially part of the other element. This definition also applies to words of similar meaning, for example, "joined", "connected", "coupled", "mounted", "bonded", "fixed" and their derivatives. Finally, terms of degree such as "substantially", "about" and "approximately" as used herein mean an amount of deviation of the modified term such that the end result is not significantly changed.

While only selected embodiments have been chosen to illustrate the present invention, it will be apparent to those skilled in the art from this disclosure that various changes and modifications can be made herein without departing from the scope of the invention as defined in the appended claims. For example, unless specifically stated otherwise, the size, shape, location or orientation of the various components can be changed as needed and/or desired so long as the changes do not substantially affect their intended function. Unless specifically stated otherwise, components that are shown directly connected or contacting each other can have intermediate structures disposed between them so long as the changes do not substantially affect their intended function. The functions of one element can be performed by two, and vice versa unless specifically stated otherwise. The structures and functions of one embodiment can be adopted in another embodiment. It is not necessary for all advantages to be present in a particular embodiment at the same time. Every feature which is unique from the prior art, alone or in combination with other features, also should be considered a separate description of further inventions by the applicant, including the structural and/or functional concepts embodied by such feature(s). Thus, the foregoing descriptions of the embodiments according to the present invention are provided for illustration only, and not for the purpose of limiting the invention as defined by the appended claims and their equivalents.

What is claimed is:

1. A cycling shoe system, wherein the cycling shoe system comprises a cycling shoe, wherein the cycling shoe comprising:

an upper having a first portion, a second portion, and an opening between the first portion and the second portion;

a sole attached to the upper, the sole having a power source located in a heel part of the sole and positioned underneath the upper;

a closure coupled between the first portion and the second portion, the closure having at least one reel;

an actuator operatively coupled to the closure by a cable to adjust a relative position of the first portion and the second portion, the actuator being powered by the power source;

a communicator configured to wirelessly receive bicycle information and user information from at least one of a bicycle and an external device; and a controller programmed to control the actuator to adjust a tightening force applied by the closure to a target tightening force based on the user information, the controller being further programmed to control the actuator to adjust the tightening force to one of a first force corresponding to a preset initial tightening force setting and a second force corresponding to an initial manual user setting upon establishing communication between the communicator and the at least one of the bicycle and the external device, the communicator including a wireless communication circuit configured to carry out wireless communication with both the external device and a plurality of bicycle sensors including a forward speed sensor, a pedaling cadence sensor, a pedaling input sensor and a GPS sensor, the communicator further including a wired communication circuit in wired communication with a second sensor located inside the shoe, the second sensor including a temperature sensor that detects a temperature inside the cycling shoe, a pressure sensor that detects a pressure on the sole, and a humidity sensor that detects a humidity inside the cycling shoe, the user information including at least one of a shoe condition and a user condition, the shoe condition including at least one of the temperature inside the cycling shoe, the pressure on the sole, the humidity inside the cycling shoe, and a preset initial tightening force setting, the controller being configured to control the actuator based on detection results of a first sensor configured to detect the tightening force applied to the upper between the first portion and the second portion, and the controller being programmed to control the actuator to adjust the tightening force to the target tightening force based on target tightening adjustments in a prestored table, the target tightening adjustments corresponding to conditions associated with the bicycle information and the user information.

2. The cycling shoe system according to claim 1, wherein the closure is configured to be manually tightened.

3. The cycling shoe according to claim 1, wherein the closure includes a strap tightener and a shoe strap extending between the first portion and the second portion.

4. The cycling shoe system according to claim 1, wherein the controller is configured to control the actuator to adjust the tightening force to the target tightening force based on the bicycle information.

5. The cycling shoe system according to claim 4, wherein the bicycle information includes a forward speed, a pedaling cadence, a pedaling input power, and global positioning coordinates.

6. The cycling shoe system according to claim 1, wherein the user condition includes at least one of heart rate, body temperature, blood oxygen concentration and blood lactate level.

7. The cycling shoe system according to claim 1, further comprising a storage device having stored one or more tightening force settings corresponding to at least one of the bicycle information and the user information.

8. The cycling shoe system according to claim 1, wherein the communicator is a wireless communicator.

9. The cycling shoe system according to claim 1, further comprising a first power source.

10. The cycling shoe system according to claim 7, wherein the first power source is a rechargeable battery.

11. The cycling shoe system according to claim 7, further comprising a non-contact charging coil configured to wirelessly receive electric power from a second power source, and to supply the electric power to the first power source.

12. The cycling shoe system according to claim 1, wherein the closure includes a first closure that is automatically operated by the controller, and a second closure that is manually operated.

13. The cycling shoe system according to claim 1, wherein the first force is a preset manufacturer setting, the controller is configured to override the first force and use the second force in response to a user setting the second force via the at least one of the bicycle and the external device.

14. A cycling shoe system, wherein the cycling shoe system comprises a cycling shoe, wherein the cycling shoe comprising:

an upper having a first portion, a second portion, and an opening between the first portion and the second portion;

a sole attached to the upper, the sole having a power source located in a heel part of the sole and positioned underneath the upper;

a closure coupled between the first portion and the second portion, the closure having at least one reel;

an actuator operatively coupled to the closure by a cable to adjust a relative position of the first portion and the second portion, the actuator being powered by the power source;

a communicator programmed to receive first information from an external device; and a controller configured to control the actuator to adjust a tightening force applied by the closure to a target tightening force based on the first information, the controller being further programmed to control the actuator to adjust the tightening force to one of a first force corresponding to a preset initial tightening force setting and a second force corresponding to an initial manual user setting upon establishing communication between the communicator and the external device, the communicator including a wireless communication circuit configured to carry out wireless communication with both the external device and a plurality of bicycle sensors including a forward speed sensor, a pedaling cadence sensor, a pedaling input sensor and a GPS sensor, the communicator further including a wired communication circuit in wired communication with a second sensor located inside the shoe, the second sensor including a temperature sensor that detects a temperature inside the cycling shoe, a pressure sensor that detects a pressure on the sole, and a humidity sensor that detects a humidity inside the cycling shoe, the first information including at least one of a shoe condition and a user condition, the shoe condition including at least one of the temperature inside the cycling shoe, the pressure on the sole, the humidity inside the cycling shoe, and a preset initial tightening force setting, the controller being configured to control the actuator based on detection results of a first sensor configured to detect the tightening force applied to the upper between the first portion and the second portion, and the controller being programmed to control the actuator to adjust the tightening force to the target tightening force based on target tightening adjustments in a prestored table, the target tightening adjustments corresponding to conditions associated with the bicycle information and the user information.

15. The cycling shoe system according to claim 14, wherein the first force is a preset manufacturer setting, the controller is configured to override the first force and use the second force in response to a user setting the second force via the external device.

* * * * *